US006202249B1

(12) United States Patent
Jenkins et al.

(10) Patent No.: US 6,202,249 B1
(45) Date of Patent: Mar. 20, 2001

(54) FLOOR COATING APPLICATION DEVICE

(75) Inventors: Mark C. Jenkins; Jay M. Jenkins, both of Magna, UT (US)

(73) Assignee: Masterpiece Hardwood Floors, Magna, UT (US)

( * ) Notice: Subject to any disclaimer, the term of this patent is extended or adjusted under 35 U.S.C. 154(b) by 0 days.

(21) Appl. No.: 09/226,896

(22) Filed: Jan. 7, 1999

(51) Int. Cl.[7] ..... A47L 13/26; A47L 13/30; A47L 13/284

(52) U.S. Cl. ..... 15/228; 15/231; 15/235; 401/139; 401/265; 401/282

(58) Field of Search ..... 15/228, 235, 247, 15/231; 401/139, 261, 265, 266, 282

(56) References Cited

U.S. PATENT DOCUMENTS

| | | | | |
|---|---|---|---|---|
| 419,871 | * | 1/1890 | Orcutt | 15/231 |
| 1,526,161 | * | 2/1925 | Lyon | 15/231 |
| 1,709,711 | * | 4/1929 | Duffy | 401/139 |
| 1,712,681 | * | 5/1929 | Tallmadge | 15/231 |
| 1,920,069 | * | 7/1933 | Endly | 401/139 |
| 1,936,361 | * | 11/1933 | Kaufmann | 401/139 |
| 3,785,001 | * | 1/1974 | Niemi et al. | 15/245 |
| 3,960,454 | * | 6/1976 | Scroeder, Jr. | 15/231 |
| 5,379,479 | * | 1/1995 | Nelson | 15/245.1 |
| 5,402,559 | * | 4/1995 | Allison et al. | 15/228 |
| 5,426,809 | * | 6/1995 | Muta | 15/231 |
| 5,487,202 | * | 1/1996 | Cowan | 15/228 |
| 5,740,578 | * | 4/1998 | Moore | 15/230.19 |
| 5,839,147 | * | 11/1998 | Chia-Yi et al. | 15/228 |
| 5,852,842 | * | 12/1998 | Stern | 15/228 |

* cited by examiner

*Primary Examiner*—Robert J. Warden, Sr.
*Assistant Examiner*—Kaj K. Olsen
(74) *Attorney, Agent, or Firm*—Trask Britt

(57) ABSTRACT

A floor coating application device with a rigid body having attached thereto a removable applicator and a removable weight system. The rigid body having a planar surface with radial edges to facilitate the uniform application of a coating material to a surface. The removable applicator being a material suitable for uniformly spreading a coating material without flaws or shedding and attached to the rigid body in such a manner as to minimize the wicking of coating material through the applicator. The removable weight system capable of providing a consistent force against the rigid body to improve the uniformity of coating thicknesses. The floor coating application device is used to spread coating material with a handle connected to the rigid body or a mechanical coating device.

24 Claims, 4 Drawing Sheets

FLOOR COATING APPLICATION DEVICE

BACKGROUND OF THE INVENTION

1. Field of the Invention

This invention relates generally to coating application devices. More particularly, the invention pertains to a floor coating application device for applying protective, functional or decorative coatings to planar surfaces, such as hardwood floors, concrete floors, and the like.

2. State of the Art

Various materials are used as protective, functional or decorative coatings for planar surfaces. Many coating materials are applied to surfaces in a liquid state, later drying to form the desired coating. It is not uncommon to apply more than one layer of a coating to a particular surface in order to increase the thickness of the overall coating and thereby improve the resiliency, durability, and longevity of the surface. The coating material is typically applied to the surface and then uniformly distributed over the surface and smoothed by an application device.

The thickness of each layer of coating material distributed over the surface varies with the type of coating material used and the amount of pressure used to apply the coating material. Because of the dependency of the coating thickness on the characteristics of the coating material, the manufactures of coating materials provide guidelines which detail the amount of coating material necessary to cover a given surface area. If the guidelines are followed, a near perfect coating thickness should be achieved. However, there are a few factors that make it difficult to achieve such a perfect coating.

The liquid state of coating materials makes it difficult to evenly spread the coating over a given surface area. The thickness of the wet coating layer often depends upon the amount of force used to spread the coating over a surface. The force originates from the application device which is typically controlled by a human operator. Many of the individuals practicing the art of coating floors have developed the skill required to judge how much force must be applied to an application device to achieve a desired coating thickness. Additionally, the speed at which the coating is spread over the surface by an operator can also make a difference in the coating thickness. Although a person spreading the coating layer may become fairly proficient in laying consistent coatings, those who are inexperienced or who are laying a new type of coating are often unable to maintain the uniformity desired in the coating thickness. Because of these human variables, the wet thickness of the coating will often vary. As the coating then dries, the thickness of the coating layer decreases and all of the imperfections in the wet thickness are magnified.

The ideal finished surface is one having multiple coating layers, dried to a uniform thickness, with as few flaws or irregularities as possible. Just as flaws and irregularities are caused by the inconsistent force and speed used to spread the coating layers, such things as the shedding of particles from the application device onto the coating layer, or particulate matter settling on the coating layers during the drying process or air bubbles forming in the liquid coating, may also cause flaws and imperfections in the coating surface. Because the coating layers are typically thin, such flaws and variances are compounded with each additional layer of coating material. To avoid such problems, application devices have been developed which decrease the amount of imperfections that occur in coating layers and aid in the application of uniform, thin layers of coating material to planar surfaces.

Typically, when an application device is used to apply a coating material to a planar surface a portion of the coating material is first applied to the surface and the application device is used to evenly spread the coating over the surface. This is accomplished by pushing or pulling the application device over the surface area upon which a coating material has been deposited. As the leading edge of the application device contacts the liquid coating material, the coating material is displaced across the edge of the application device. As the application device is pushed or pulled over the surface, a layer of coating material is deposited between the application device and the surface being coated. Occasionally, a mechanical device is used to push or pull the application device over the surface and thereby spread the coating material.

As coating material builds up on the application device the excess coating material is squeezed out of the applicator. This is accomplished by tapping, knocking, slapping, or pressing the application device against a hard surface to force the excess coating out of the applicator material. After the completion of a coating layer the applicator must be cleaned if it is to be used again. The applicator is cleaned by immersing the entire piece of material in a solvent. The applicator may then be reattached to the application device and the process of coating a surface may begin again.

There are a number of different types of floor coating application devices currently being used to apply coatings to planar surfaces such as hardwood and cement floors. One such application device consists of a body piece, an applicator and a handle used to guide the device. The body of the device is essentially a rectangular block made of a rigid material. The body typically has a length of approximately eighteen inches, a width of four to six inches and a thickness sufficient to maintain the rigidity of the body. These dimensions create two opposing sides with large surface areas. The body acts as a rigid support to which an applicator may be fastened. An applicator is a piece of material, such as lamb's wool or synthetic lamb's wool, which wraps around the body in such a manner that one of the two sides of the body is completely covered by the applicator. The edges of the applicator are secured to the second side of the body so that the applicator is fixed on the body and will not move when subjected to external forces. A handle is typically attached to the exposed second side of the body, extending in an upwardly direction.

A second type of application device is similar to the first device in all respects except for the applicator. Instead of having an applicator which is fastened about the body of the application device, the applicator material is directly attached to the body. Typically, the applicator material is a flocking or set of bristles which are glued or permanently attached to the application device.

A third type of application device consists of a tubular body to which an applicator is permanently attached. The applicator is securely fastened around the circumference of the tubular body. The tubular body typically contains a flat plate attached thereto for a detachable handle to be secured. This type of application device provides a smaller contact surface area then the device mentioned above.

Although the application devices currently used to apply coating materials to planar surfaces are sufficient to achieve adequate floor coatings, there are a number of problems associated with their use. One of those problems is wicking. As an application device spreads coating material over a surface, the coating material wicks throughout the applicator, saturating it with the coating material. Coating buildup on the applicator caused by such wicking can result in the uneven distribution of coating material over the surface. Excess coating material drips off of the back or the sides of the application device during normal use or splatters when trying to remove the excess coating from the applicator. The droplets disrupt the uniform nature of the coated surface, decreasing the quality of the finished coating.

Additionally, wicking presents undesired results when attempting to apply coating to a planar surface which contacts a perpendicular surface, such as where a floor and a wall join. Application of the coating material to the entire floor necessitates that the outer edges of the application device contact the wall at some point. If this contact occurs after coating material has wicked through the applicator, the coating is applied to the wall. This is undesirable.

Current solutions to rid the application device of unwanted coating buildup caused by wicking include forcing the excess coating material out of the applicator by squeezing the applicator against a hard surface or replacing the applicator. Often times, the squeezing or slapping of the applicator against a surface to rid the application device of the unwanted coating material results in a spattering of coating droplets which can disrupt a uniform surface which has already been coated. Replacing the applicator is also disadvantageous. Removing the applicator from the current application devices is time consuming and often very messy. The tubular application devices pose significant cleaning problems because the entire tube must be immersed in a solvent. This requires that large cleaning vessels filled with large amounts of solvent are kept on hand to clean the applicators.

Another problem associated with the application of coating materials to planar surfaces is the unevenness of the coating layers. The four to six inch wide application device tends to produce more variance in the thickness of coating layers than application devices with smaller application surface areas. In addition, the larger surface area requires a larger applicator, which provides more wool which can shed off of the applicator and deposit flaws in the coating layers. Likewise, the application device having the permanent applicator material attached thereto has been found to be prone to excess shedding of material into the coating layers. Such shedding creates flaws and imperfections in the coating layers which is undesirable.

The thickness of each coating layer is dependent upon the pressure applied to the application device by the individual spreading the coating. Various coatings have different viscosities, thus the pressure applied by the operator varies the thickness of the coating being applied. Typically, an operator becomes proficient with the various coatings and is able to apply the desired pressure necessary to achieve the desired coating thickness. However, this does not provide a standard, consistent force which produces uniform coating layers because it is very difficult to maintain a constant, and consistent downward force on the application device.

BRIEF SUMMARY OF THE INVENTION

The current invention comprises a floor coating application device for the application of coatings to planar surfaces such as hardwood floors, concrete floors, and the like, including a rigid body, an applicator, a force control system, and a handle.

The body of the application device is made of a rigid material unreactive to the coating materials and solvents used in the art. The body has at least one planar surface which is used in substantial parallel proximity to a surface being coated. The ends of the body are beveled or curved to prevent the transfer of coating material to surfaces perpendicular to the surface being coated, such as walls. The edges of the body are radially curved to improve the displacement of a coating material along the body edges during use.

Fasteners, such as VELCRO™, screws, other threaded fasteners, or hooks may be secured to the sides of the body to facilitate the connection of the applicator to the body. Likewise, the top surface of the body is fitted configured for a force control system removably connected to the body.

The applicator is removably connected to the body of the application device in such a manner that a portion of the applicator covers the planar surface of the body. At least the portion of the applicator covering the planar surface of the body is typically a piece of lamb's wool or synthetic lamb's wool. Naturally tanned lamb's wool is the preferred material because it does not shed. The edges of the applicator may be reenforced with leather strips in order to decrease the amount of wicking through the applicator and improve the strength of the connection between the applicator and the body of the application device.

The force control system connected to the body of the application device provides a consistent force to the body which improves the uniformity of the coating thickness layers applied with the application device and which provides the proper amount of force on the application device necessary to apply a variety of coatings. The typical force control system includes one or more weights, such as a polished brass weight connected to a top surface of the body. The system of weights is removable.

A handle is typically attached to the body or to a handle attachment which is attached to the body. The attachment between the handle and the body may allow the position of the handle, with respect to the body, to be altered. In addition, the handle may be secured in a specific position.

DESCRIPTION OF THE ILLUSTRATED EMBODIMENTS

Figure 1:
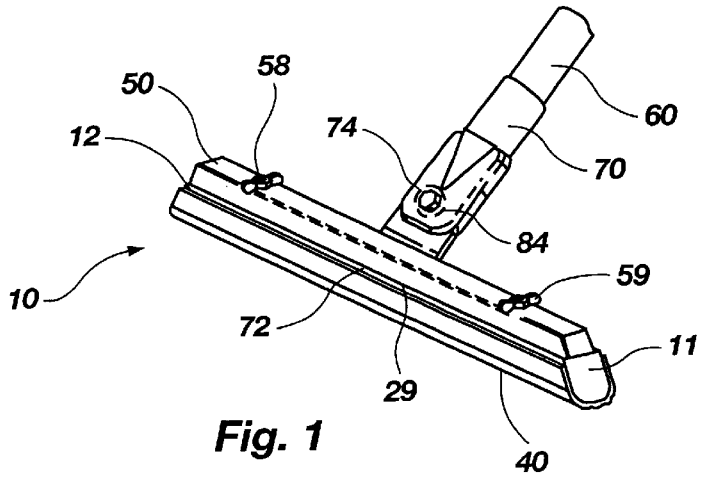
FIG. 1 is a front side view of the application device.
Figure 2:
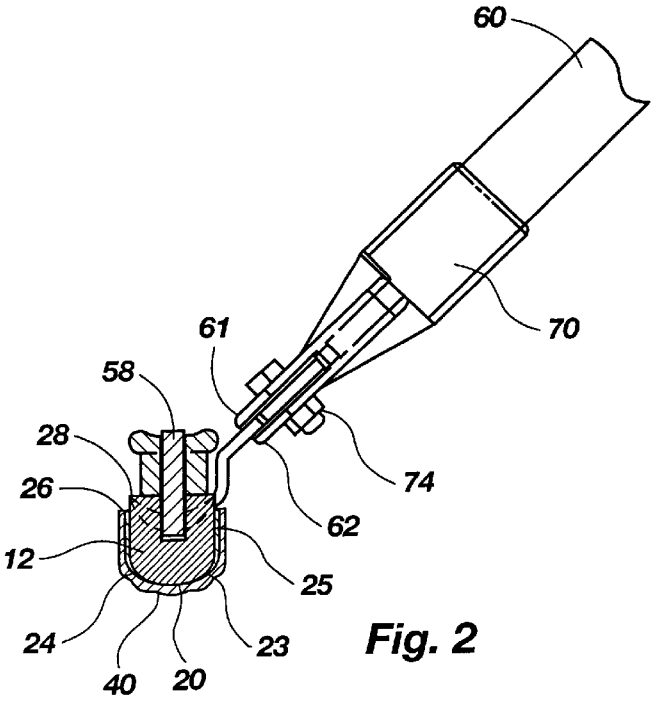
FIG. 2 is a cross-sectional side view of the application device.

Referencing FIGS. 1 and 2, a preferred embodiment of the floor coating application device 10 is shown. The application device 10 comprises a body 12, an applicator 40, a force control system 50, a handle 60 and a handle attachment 70.

Figure 6:
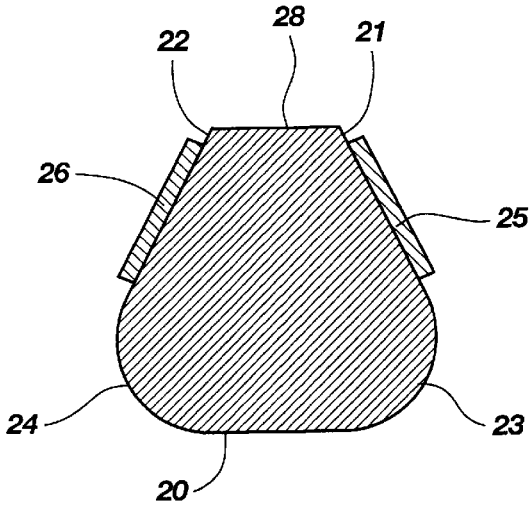
FIG. 6 is a cross-sectional side view of the body of the application device.
Figure 7:
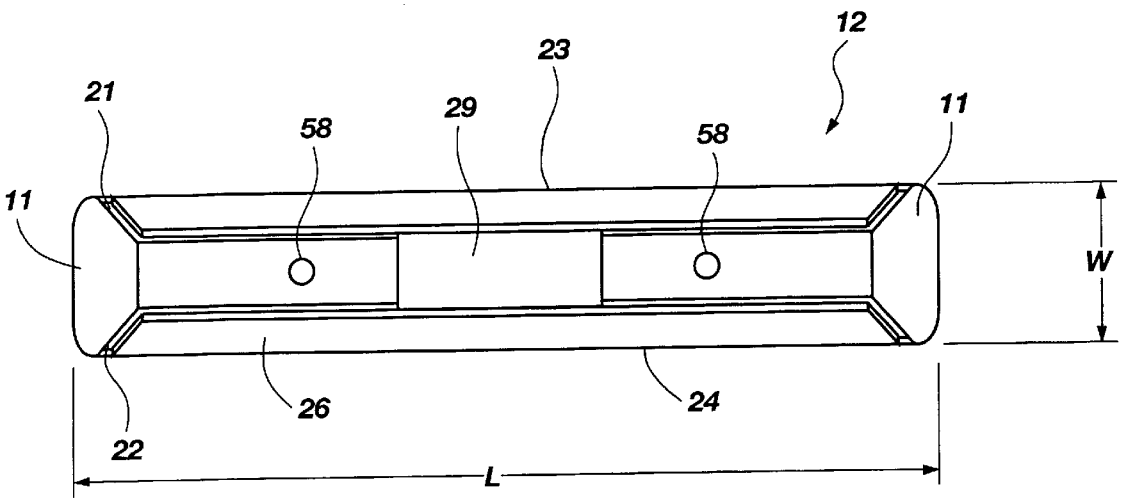
FIG. 7 is a top view of the body of the application device.
Figure 8:
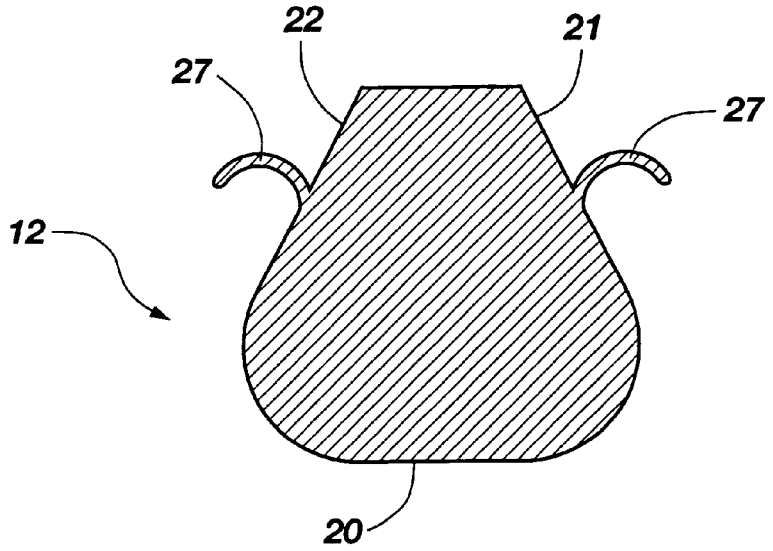
FIG. 8 is a cross-sectional side view of an alternative embodiment of the body of the application device.

Different embodiments of the body 12 are depicted in FIGS. 6–8. Each embodiment, however, has certain standard features. The body 12 of the application device 10 is made of a substantially rigid material, such as hard maple wood, steel, aluminum, a high density polyethelene or other plastic, wood or a metal materials, or a combination thereof. It is important that the material of the body 12 does not react with the various coating materials and solvents that are used in the floor coating art. The ends 11 of the body 12 are beveled or curved inward at a desired angle or radius of curvature wherein the bottom surface 20 having a greater or longer length than that of the top surface 28. An application device 10 having a body 12 with beveled ends 11 is desirous because the beveled ends 11 prevent coating material from transferring to a wall or other planar surface perpendicular to the surface that is being coated. The length and width of the body 12 may vary depending upon the job at hand. However, a body 12 having a length of about or approximately eighteen inches and a width of about or approximately one inch has been found to provide the application of substantially uniform coatings. Having a body 12 width, typically in the range of about or approximately one to two inches, smaller than the typical four to six inch width of prior art devices greatly improves the uniformity of the coating layer and decreases the number of imperfections that may appear in the coating layer as a result of the applicator shedding.

A preferred embodiment of the body 12 is illustrated in FIGS. 6 and 7. Although the body 12 of the application device 10 may be any shape, the footprint of the bottom surface 20 of the body 12 is essentially a rectangle having a length "L" of about or approximately eighteen inches and a width "W" of about or approximately one inch, although a width of approximately two inches or slightly greater may be used. A first bottom edge 23 extending along the length of the body 12 radially connects the bottom surface 20 with a first side surface 21. Likewise, a second bottom edge 24 extending along the length of the body 12 radially connects the bottom surface 20 with a second side surface 22. Both side surfaces 21, 22 slope inward from the edges 23, 24 to a top surface 28.

The radially curved nature of the bottom edges 23, 24 controls the size of the coating material fillet, such as decreasing the size of the coating fillet that accumulates between the applicator 40 and the surface being coated. The radially curved nature of the edges 23, 24 also controls the wicking of coating material, such as decreasing the amount of wicking which occurs between the coating material and the applicator 40. Such control features of the bottom edges 23, 24 help to provide a more uniform layer of coating material and reliable application of a layer of coating material to the application surface.

The body 12 may also be constructed in a manner to decrease the amount of wicking that occurs up the side surfaces 21, 22 of the body 12. As illustrated in FIG. 8, fitting the side surfaces 21, 22 of the body 12 with dams 27, of any suitable geometric size and shape which will prevent coating material from depositing on the body 12 above the dams 27. This decreases the potential for coating buildup on the body 12 of the application device 10. Wicking may also be decreased by covering the side surfaces 21, 22 of the body 12 with a slick low surface tension material such as TEFLON™, (polytetrafluoroethylene) or the like. Use of either a TEFLON™ or similar covering over the body 12 or dams 27 on the side surfaces 21, 22 of the body 12 reduces coating buildup, resulting in fewer flaws due to coating droplets falling onto the finished coating surface during application or when squegeeing the applicator 40.

FIGS. 1 and 2 illustrate a substantially or approximately cubic, or square cross-sectional body 12, an alternative embodiment of the body 12. Such a cubic body 12 provides a greater surface area on the top surface 28. The larger top surface 28 facilitates the attachment of a larger force control system 50.

Fasteners 25, 26 may be fixed to the first and second side surfaces 21, 22 of the body 12 to anchor the applicator 40 to the body 12. The fasteners 25, 26 in the preferred embodiment are strips of VELCRO™ (hook and loop fasteners) hooks which are permanently affixed to the body 12. The fasteners 45, 47 of the applicator 40 mesh with the fasteners 25, 26 of the body 12, securely anchoring the applicator 40 around the bottom surface 20 and side surfaces 21, 22 of the body 12. Although the fasteners 25, 26 illustrated in FIG. 6 terminate on the side surfaces 21, 22 of the body 12, it is sometimes desirous for the fasteners 25, 26 to extend over different portions of the bottom surface 20 and side surfaces 21, 22 of the body 12, including the edges 23, 24. Typically, the applicator 40 is temporarily anchored to the body 12 in order to facilitate easy attachment and removal of the applicator 40. However, the applicator 40 may be permanently anchored to the body 12 with such things as glue, staples, screws, other threaded fasteners, nails and the like. However, it is preferred that the applicator 40 be easily detachable from the body 12 with minimal effort, regardless of the fastening system used.

The top surface 28 of the body 12 may be fitted to hold a force control system 50 which aids in the distribution of an even pressure or force between the application device 10 and the coating being applied to a surface. The force control system 50 may be attached to the top surface 28 of the body 12 in any manner. The top surface 28 may be formed with a curvature such that a cylindrical force control system 50 would rest snugly on the complementary top surface 28 of body 12 (see broken lines in FIG. 2). The force control system 50 may also be attached to the top surface 28 using fastener straps (see broken lines in FIG. 2) attached to the top surface 28 of the body 12. In addition, it has been found that the body 12 may be fitted with pegs or suitable threaded fasteners 58 which extend upwards from the top surface 28 in such a manner that a force control system 50 having receptacles for the pegs or fasteners 58 may fit snugly over the pegs or fasteners 58, resting on the top surface 28. The pegs or fasteners 58 may also be threaded in manner to accept a wing nut 59 or other fastening device to secure the force control system 50 to the body 12 of the application device 10. The method of attaching the force control system 50 to the body 12 may vary, as long as the force control system 50 is easily removable and fits snugly and securely to the body 12 of the application device 10 during use and operation of the application device 10.

Figure 9:
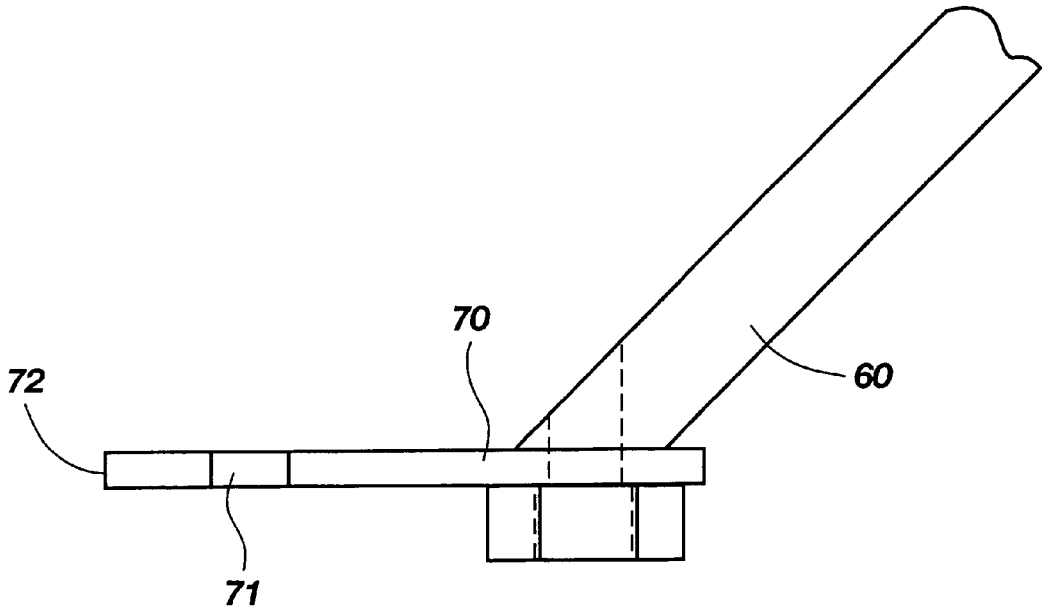
FIG. 9 is a side view of an alternative attachment of the handle to the handle attachment.

Additionally, the top surface 28 or one of the side surfaces 21, 22 of the body 12 may be fitted to accept a handle attachment 70 or the direct attachment of a handle 60. FIG. 1 illustrates a handle attachment 70 fitted into a recess 29 on the top surface 28 of the body 12. The recess 29 is illustrated in FIG. 7. One version of the handle attachment 70 is illustrated in FIG. 9. Typically, the handle attachment 70 is a metal plate, or similar sturdy material, which facilitates the attachment of a handle 60 to the body 12. A front edge 72 of the handle attachment 70 may be fitted into the recess 29 of the body 12 and secured thereto. The handle attachment 70 may be secured to the body 12 with glue, screws, bolts, nails, or any suitable similar type attachment devices of sufficient strength. The handle attachment 70 illustrated in FIG. 9 may have at least one eyelet 71, which will allow a suitable fastener, such as a threaded fastener, screw, or nail to be used to secure the handle attachment 70 within the recess 29 of the body 12. The handle attachment may also be secured to one of the side surfaces 21, 22 of the body 12. It is important that the handle attachment 70 or the handle 60 do not interfere with the force control system 50.

The applicator 40 must be constructed of a material which does not shed particles during use because such particles are deposited in the coating surface causing imperfections which are undesirable. Typically, a piece of lamb's wool or synthetic lamb's wool is used as the applicator 40 because the lamb's wool has minimal shedding. For oil based materials or the like, the ideal material is natural lamb's wool that has been tanned naturally with chromium, for minimizing the amount of shedding of wool. The lanolin in the naturally tanned lamb's wool helps to improve the life of the applicator 40 and to decrease the amount of shedding or breakage of wool fibers that occurs. Typically, the lamb's wool is used to apply oil based coating materials and the like, while the synthetic lamb's wool is used to apply water based coating materials and the like.

Figure 3:
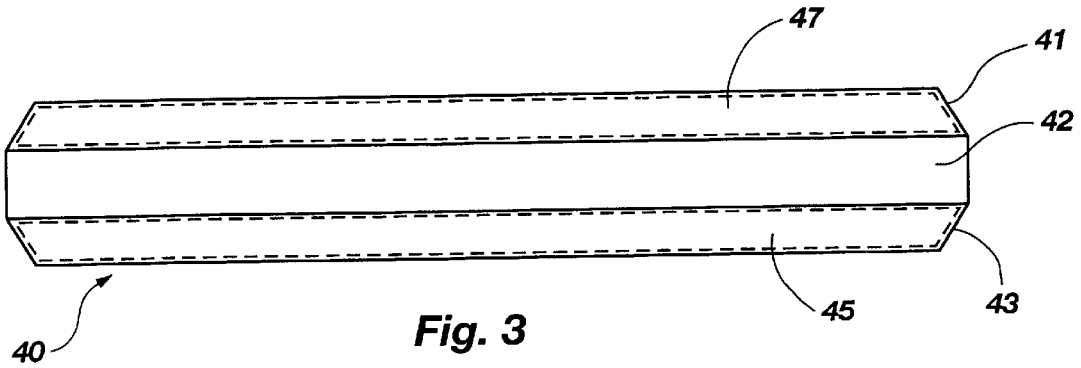
FIG. 3 is a back view of the applicator which attaches to the application device.

FIG. 3 illustrates the preferred embodiment of the applicator 40 for the application device 10. Although the shape of the applicator 40 illustrated is matched to fit the body 12 of the application device 10, rectangular or differently shaped applicators 40 may also be used. The application material 42 has two sides, an application side and a back side. The back side is the side that contacts the body 12 of the application device 10. Two leather strips 41, 43 are attached to opposite edges of the backside of the application material 42. The leather strips 41, 43 may overlap the application material 42 or extend beyond the edge of the application material 42. The leather strips 41, 43 provide additional support to the applicator 40 while providing a surface upon which a fastener device 45, 47 such as Velcro™ hooks may be attached. The applicator 40 is attached to the body 12 of the application device 10 by connecting one fastener device 45 with one of the fasteners 26 of the body 12 and the other fastener device 47 with the second fastener 25 of the body 12.

In addition to providing additional support to the applicator 40, it has been found that the leather strips 41, 43 help prevent wicking through the applicator 40 up the sides of the body 12 of the application device 10. The leather strips 41, 43 act as a dam, preventing the coating material from wicking away from the surface of the applicator 40 in contact with the bottom surface 20 of the body 12. This helps reduce excess buildup of coating on the applicator 40 and the body 12, thus preventing imperfections in the coating surface caused by droplets of coating disengaging from the applicator 40.

The smaller size of the applicator 40 used with the application device 10 has numerous advantages. First, a smaller amount of solvent and smaller containers are required to clean the applicator 40. Applicators 40 are typically cleaned and reused after each job. Cleaning the applicator 40 involves immersing the applicator 40 in a solution which will dissolve the coating material that has soaked into the applicator 40 during the application process. Water is used to clean applicators 40 which have been used to apply water based coatings, while a solvent of some sort is typically used to clean the applicators 40 which have been used with oil based solvents. The applicators used in the current art must be cleaned in large containers because of their size. The smaller size of the applicators of the current invention allow easier cleaning at the job site while decreasing the amount of solvent that must be used.

The second advantage to using a smaller piece of application material 42 to construct the applicator 40 is a cost savings. Naturally tanned lamb's wool is relatively expensive. The decreased size of the application material 42 required in the current invention decreases the cost of the applicator 40 while providing a superior finish in the coating applications.

A third advantage to using a smaller flexible piece of application material 42 is that it may be easily packaged and readily transported as well as displayed for sale.

It may be necessary at times to attach a removable force control system 50 to the body 12. The force control system 50 may be a single weight capable of spanning either less than or the entire length of the body 12 of the application device 10, or it may be a series of separate weights attached to the body 12 at different locations, as well as stacked, one upon another, on the application device 10 as required. Changing the weight of the force control system 50 increases or decreases the pressure or force exerted by the body 12 on the coating material and surface which is being coated. Varying the total weight of the force control system 50 allows the operator to precisely control the pressure applied to the body 12 thus improving the uniformity of the coating layers and quality of the coating. Therefore, it is important to have a force control system 50 which may be easily removed and changed with a lighter or heavier force control system 50 depending upon the characteristics of the coating material that will be spread with the application device.

Figure 4:
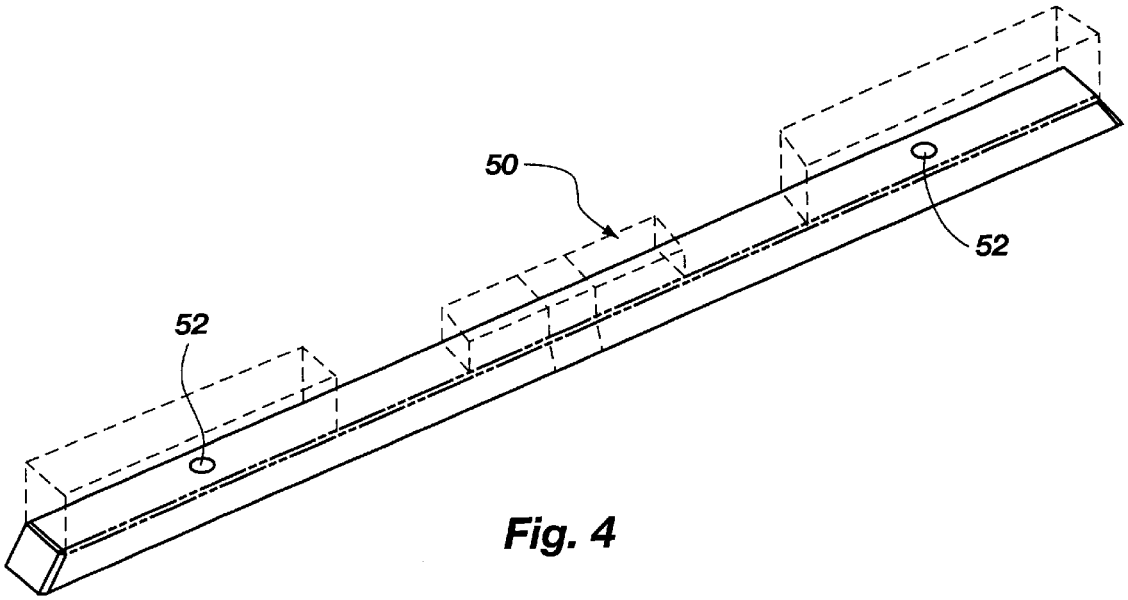
FIG. 4 is top side view of the force control system which attaches to the application device.

The preferred embodiment of the force control system 50 is illustrated in FIG. 4. The preferred force control system 50 is a solid piece of polished brass having at least two recesses 52 to accept the pegs 58 (see FIG. 2) of the body 12 when attached to the application device 10. The presence of at least two recesses 52 prevents the force control system 50 from moving when attached to the body 12 of the application device 10. The force control system 50 may consist of any metal or material capable of providing the amount of weight necessary to produce the desired coating thickness. The force control system 50 may have a rectangular, cylindrical or other shape, as long as the desired total weight is able to be achieved. Additionally, the force control system 50 may consist of more than one weight, any desired number (see broken lines in FIG. 4), and may be fastened or attached to the body 12 in a different manner, such as being attached by fastener strips anchored to the body 12 of the application device 10.

The force control system 50 in the current invention greatly improves the uniformity of the coating surfaces applied using the application device 10. The force control system 50 places a uniform force upon the body 12 of the application device 10 which may be easily changed to adapt to the characteristics and requirements for the different types of coatings. More weight can be added to the force control system 50 to produce a thinner layer of coating or to apply a coating having a thicker viscosity. Likewise, weight can be removed from the force control system 50 when a thicker coating of material is desired or where the viscosity of the coating material is such that very little force is needed to ideally spread the coating material. Prior to the current invention, the thickness of the coating layers depended upon the pressure that an operator manually applied to an application device. Coating layers applied in such a manner are often irregular because the pressure applied by the operator constantly varies. Use of the force control system 50 ensures the uniformity of the coating layer by removing much of the human factor in the application process. In addition, the force control system 50 takes some of the guesswork and the skill out of applying a coating material to surfaces. The force control system 50 enables those who are not skilled, or who have limited skill, in the art of applying coating surfaces, to produce a uniform coating layer without any, or little, experience.

A handle 60 is connected to either the body 12 of the application device 10 or to a handle attachment 70 secured to the body 12. The handle 60 is made of a material sturdy enough to withstand forces placed upon it by the operator of the application device 10 during normal use. The handle 60 must be able to withstand the forces placed upon it when a person taps, knocks, slaps or attempts to squeeze any excess coating material off of the applicator 40 while it is still attached to the body 12. Such forces include the weight of the operator pressing on the handle 60 with sufficient force to squeeze excess coating material out of the applicator 40. In order to withstand such forces, the handle 60 is typically constructed of a hard wood, a metal or high density polyethelene, carbon fiber resin material, or polycarbonate material. The handle 60 may be any shape, size or length as long as it facilitates the use of the application device 10.

In the preferred embodiment, the handle 60 is attached to a handle attachment 70 which is secured to the body 12. The handle 60 may be attached to the handle attachment 70 using various configurations. There are situations where it is desirous to have a handle 60 permanently fixed to the handle attachment 70 and other situations where the handle 60 must be able to rotate on the handle attachment 70. A fixed connection between the handle 60 and handle attachment 70 may be accomplished using a bolt and nut combination 74 to join the two parts as illustrated in FIG. 1. The bolt may also be fitted with a wing nut. Such a configuration allows the wing nut to be loosened, the handle 60 to be rotated, and the wing nut tightened in order to fix the handle 60 in a new position on the handle attachment 70.

A configuration allowing the handle 60 to rotate about the handle attachment 70 during operation of the application device 10 is a fork connection as illustrated in FIG. 2. The base of the handle 60 separates into an upper fork portion 61 and a lower fork portion 62 between which there is enough space for the handle attachment 70 to fit. The upper and lower fork portions 61, 62 may be secured to the handle attachment 70 with a nut and bolt combination or with a sealed bearing system. Use of a sealed bearing system allows the handle 60 to rotate about the handle attachment 70 while using the application device 10. A sealed bearing system 84 (FIG. 1) may be used to prevent the freezing of the rotational quality of the handle 60 due to excessive coating buildup that may occur.

The handle 60 may also be attached directly to the body 12 of the application device 10 without using a handle attachment 70. Additionally, the handle attachment 70 may be configured to secure the body 12 to a mechanical floor coating device instead of to a handle.

Figure 5:
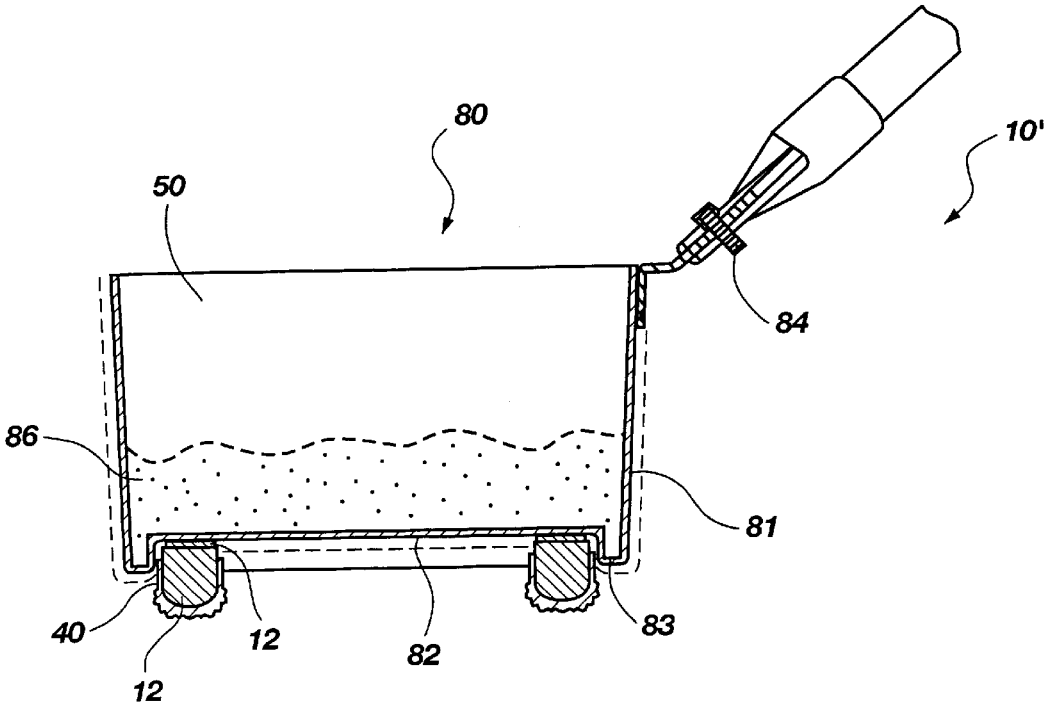
FIG. 5 is a cross-sectional side view of an alternate embodiment of the application device.

FIG. 5 illustrates another embodiment 10' of an application device 10 of the present invention. This embodiment comprises a container 80, having a recessed bottom surface 82 and side walls 81, for holding and distributing a coating material. The container 80 has a plurality of openings 83 for the gravitational distribution of liquid coating materials. Two bodies 12 are attached by their top surfaces 28 to the bottom surface 82 of the container 80. The attachment between the bodies 12 and the bottom surface 82 of the container 80 must be such that the bodies 12 will not separate from the container 80 as the application device 10 is pushed or pulled across a planar surface. The container 80 of the application device 10 is attached to a handle attachment 70 and a handle so that the application device 10 may be pushed or pulled across a surface to be coated. As the application device 10 is pushed or pulled across the surface being covered, coating material is dispensed through the openings 83 in the container 80 and evenly spread by the bodies 12 attached to the bottom surface 82 of the container 80. Application of the coating material is thus achieved in substantially the same manner as with the application device embodiments previously explained.

In the embodiment 10' of the application device 10, the force control system 50 includes the container 80 and the amount of coating material 86 included therein. The weight of the container 80 may vary, depending upon the type of coating material to be used, as well as the amount or volume of the coating material contained within container 80. The thickness of the container 80 may vary (shown by broken lines in FIG. 5) to control the force exerted on the bodies 12.

It is understood that additions, deletions, modifications, and other changes to the invention may be made which are within the scope of the invention as described and claimed herein.

What is claimed is:

1. A floor coating application device comprising:

at least one rigid body having a bottom surface, a front radial edge connecting said bottom surface to a front side surface extending upwardly away from said bottom surface, a back radial edge connecting said bottom surface to a back side surface extending upwardly away from said bottom surface, each of said surfaces terminating at a top surface opposite said bottom surface, said at least one rigid body having beveled ends, each of said side surfaces coated with a slick low surface tension material consisting of polytetrafluoroethylene;

an applicator removably connected to said at least one rigid body, the applicator covering at least a portion of said bottom surface of said at least one rigid body;

a force control system connected to the top surface of said at least one rigid body;

and a handle connected to one of said at least one rigid body and said force control system by an attachment.

2. The floor coating application device of claim 1, wherein said bottom surface is planar.

3. The floor coating application device of claim 1, wherein said force control system includes at least one weight.

4. A floor coating application device comprising:

at least one rigid body having a planar bottom surface, a front radial edge connecting said bottom surface to a front side surface extending upwardly away from said bottom surface, a back radial edge connecting said bottom surface to a back side surface extending upwardly away from said bottom surface, each of said side surfaces terminating at a top surface opposite said bottom surface, said at least one rigid body having beveled ends, each of said side surfaces coated with polytetrafluoroethylene;

an applicator removably connected to said at least one rigid body, a portion of said applicator covering said bottom surface of said at least one rigid body;

a force control system removably connected to said top surface of said at least one rigid body;

a handle attachment connected to said at least one rigid body; and a handle connected to said handle attachment.

5. The floor coating application device of claim 4, wherein said at least one rigid body includes at least one dam secured to each of said side surfaces to prevent wicking.

6. The floor coating application device of claim 4, wherein said at least one rigid body includes at least one fastener device for removably connecting said force control system to said rigid body.

7. The floor coating application device of claim 4, wherein said at least one rigid body includes at least one fastener device secured to each of said side surfaces for removably connecting said applicator to said at least one rigid body.

8. The floor coating application device of claim 4, wherein said at least one rigid body includes at least one hook and loop fastener device secured to each of said side surfaces for removably connecting said applicator to said at least one rigid body.

9. The floor coating application device of claim 4, wherein said at least one rigid body includes a recess in said top surface shaped to snugly receive said handle attachment.

10. The floor coating application device of claim 4, wherein said at least one rigid body includes at least one peg extending upward from said top surface for receiving and securing said force control system.

11. The floor coating application device of claim 4, wherein said portion of said applicator is tanned natural lamb's wool.

12. The floor coating application device of claim 4, wherein said portion of said applicator is a synthetic material.

13. The floor coating application device of claim 4, wherein said applicator includes a substantially rectangular piece of material having two long edges and a strip of leather secured to each of said long edges.

14. The floor coating application device of claim 4, wherein said applicator includes at least one hook and loop fastener device secured to said applicator for removably connecting said applicator to said at least one rigid body.

15. The floor coating application device of claim 4, wherein said applicator is removably connected to said at least one rigid body by hook and loop fastener.

16. The floor coating application device of claim 4, wherein said force control system includes at least one weight.

17. The floor coating application device of claim 4, wherein said force control system includes at least one polished brass weight.

18. The floor coating application device of claim 4, wherein said force control system includes at least one recess for removably connecting to said at least one rigid body.

19. The floor coating application device of claim 4, wherein said force control system includes an apparatus removably connected to said at least one rigid body by at least one bolt and nut combination.

20. The floor coating application device of claim 4, wherein said handle comprises wood, metal, high density polypropylene, or the like.

21. The floor coating application device of claim 4, wherein said handle is connected to said at least one rigid body by at least one nut and bolt combination.

22. The floor coating application device of claim 4, wherein said handle is connected to said at least one rigid body with a rotatable fork connection.

23. A floor coating application device comprising:

at least one rigid body having a planar bottom surface, a front radial edge connecting said bottom surface to a front side surface extending upwardly away from said bottom surface, a back radial edge connecting said bottom surface to a back side surface extending upwardly away from said bottom surface, each of said side surfaces terminating at a top surface opposite said bottom surface, and beveled ends, each of said side surfaces coated with polytetrafluoroethylene;

an applicator removably connected to said at least one rigid body, a portion of said applicator covering said bottom surface of said at least one rigid body;

a force control system removably connected to said at least one rigid body; and a coupling attachment connected to said at least one rigid body for attaching said floor coating application device to a mechanical floor coating application device.

24. A floor coating application device comprising:

a force control system including a container having a bottom surface and side walls thereby creating a volume for containing coating material, a portion of said bottom surface having a plurality of openings for dispensing coating material located in a portion of said container;

at least two rigid bodies each having a planar bottom surface, a front radial edge connecting said bottom surface to a front side surface extending upwardly away from said bottom surface, a back radial edge connecting said bottom surface to a back side surface extending upwardly away from said bottom surface, each of said side surfaces terminating at a top surface opposite said bottom surface, and beveled ends, said top surface of said at least two rigid bodies attached to said bottom surface of said container, each of said side surfaces of each of the at least two rigid bodies coated with polytetrafluoroethylene;

an applicator removably connected to each of said at least two rigid bodies, a portion of said applicator covering said bottom surface of each of said at least two rigid bodies; and a handle connected to said container of said force control system.

* * * * *

UNITED STATES PATENT AND TRADEMARK OFFICE

CERTIFICATE OF CORRECTION

PATENT NO. : 6,202,249 B1
DATED : March 20, 2001
INVENTOR(S) : Mark C. Jenkins and Jay M. Jenkins It is certified that error appears in the above-identified patent and that said Letters Patent is hereby corrected as shown below:

Column 1,
Line 25, change “manufactures” to -- manufacturers --

Column 2,
Line 60, change “then” to -- than --

Column 10,
Line 32, change “slick low” to -- low slick --

Column 11,
Line 6, after “said” and before “rigid” insert -- at least one --
Line 37, after “by” and before “hook” insert -- a --

Signed and Sealed this

Sixteenth Day of March, 2004

JON W. DUDAS
*Acting Director of the United States Patent and Trademark Office*